United States Patent [19]

Ziegler et al.

[11] Patent Number: 4,945,877

[45] Date of Patent: Aug. 7, 1990

[54] FUEL INJECTION VALVE

[75] Inventors: Ewald Ziegler, Heimsheim; Joerg Widera, Gerlingen; Stefan Arndt, Stuttgart; Nikolaus Simon, Murnau A Staffelsee, all of Fed. Rep. of Germany

[73] Assignee: Robert Bosch GmbH, Stuttgart, Fed. Rep. of Germany

[21] Appl. No.: 317,509

[22] Filed: Mar. 1, 1989

[30] Foreign Application Priority Data

Mar. 12, 1988 [DE] Fed. Rep. of Germany ..... 3808396

[51] Int. Cl.[5] ..... F02M 39/00

[52] U.S. Cl. ..... 123/472; 123/531; 239/464

[58] Field of Search ..... 123/472, 471, 470, 469, 123/468, 531; 239/464, 468, 471

[56] References Cited

U.S. PATENT DOCUMENTS

| | | | |
|---|---|---|---|
| 2,920,831 | 1/1960 | Johnsyn | 239/464 |
| 3,095,153 | 6/1963 | Soth | 239/464 |
| 3,958,757 | 5/1976 | Happel | 239/125 |
| 3,985,301 | 10/1976 | Tindall | 239/464 |
| 4,087,050 | 5/1978 | Tsuji | 239/568 |
| 4,235,210 | 11/1980 | Sumiyoshi | 123/471 |
| 4,292,947 | 10/1981 | Tanasawa | 123/472 |
| 4,387,677 | 6/1983 | Guerrier | 123/472 |
| 4,515,129 | 5/1985 | Stettner | 123/472 |
| 4,519,370 | 5/1985 | Iwata | 123/472 |
| 4,690,718 | 9/1987 | Hofbauer | 123/472 |
| 4,773,374 | 9/1988 | Kiuchi | 123/470 |

FOREIGN PATENT DOCUMENTS

| | | | |
|---|---|---|---|
| 0302637 | 2/1989 | European Pat. Off. | 123/472 |
| 1229142 | 9/1960 | France | 123/420 |
| 858966 | 1/1961 | United Kingdom | 123/472 |

*Primary Examiner*—Carl Stuart Miller

*Attorney, Agent, or Firm*—Edwin E. Greigg

[57] ABSTRACT

The fuel injection valve according to the invention enables an improvement in the fuel preparation and hence a more uniform fuel-air mixture while simultaneously supplying different inlet valves of an engine from one fuel injection valve. Downstream of the valve seat face of the fuel injection valve, the fuel enters a central opening from which tangential conduits lead to at least two swirl chambers disposedly spaced apart from one another and which discharge into these chambers at a tangent. From the center of each swirl chamber, which may be embodied in an attachment, a respective metering opening leads to the outside, by way of which fuel can be injected, well prepared, in the form of cone-shaped fuel streams. The fuel injection valve is suitable either for supplying individual inlet valves with a plurality of fuel streams, or for supplying different inlet valves of the engine with fuel at the same time.

14 Claims, 1 Drawing Sheet

FUEL INJECTION VALVE

BACKGROUND OF THE INVENTION

The invention is based on a fuel injection valve for a fuel air mixture type of internal combustion engine. A fuel injection valve is already known (German Offenlegungsschrift No. 36 33 612) in which fuel is sprayed in the form of various streams, which may be aimed at various inlet valves of the engine. This fuel injection valve has the disadvantage, however, of lacking any special provisions for preparing the fuel, so that the fuel is ejected into the aspirated air in a more or less string-shaped stream, with large fuel droplets; this causes increased, undesirable wetting of the wall of the air intake tube with fuel, which in turn supplies the engine with a fluctuating fuel-air mixture in an uncontrolled manner, especially if the driver of the vehicle takes an action that causes a sudden opening or closing of the throttle valve disposed in the air intake tube.

In another fuel injection valve (German Offenlegungsschrift No. 24 60 111), swirling of the fuel downstream of the valve seat face has been provided, after which the fuel is sprayed in a cone-shaped fuel stream through a metering opening into the air intake tube.

OBJECT AND SUMMARY OF THE INVENTION

The fuel injection valve according to the invention has an advantage over the prior art in that it enables the generation of two cone-shaped fuel streams, in which superfine fuel droplets are formed, and avoids wetting of the air intake tube wall while assuring the supply of the most homogeneous possible fuel-air mixture to the engine. The at least two cone-shaped fuel streams may be aimed at one inlet valve or at various inlet valves of an engine. The fuel-air mixture, which because of the embodiment of the fuel injection valve according to the invention is homogeneous and well prepared, brings about a reduction in fuel consumption and in the proportion of toxic components in the engine exhaust.

One advantageous feature of the invention provides that the metering openings are inclined with respect to the longitudinal axis of the valve housing, so that the course of the cone-shaped fuel streams can be adapted as desired to engine requirements.

Another advantageous feature is to have the tangential conduits discharge into the swirl chambers in such a way that identical swirl directions arise in the swirl chambers. As a result, the swirl directions in the injected cone-shaped fuel streams are identical as well, and the production of negative pressure between the streams, which could make them interact undesirably, is avoided.

It is particularly advantageous to provide the metering openings, tangential conduits and swirl chambers in an attachment element that can be mounted on the housing, so that fast, simple adaptation of a fuel injection valve to the various requirements for its use in various engines is possible.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
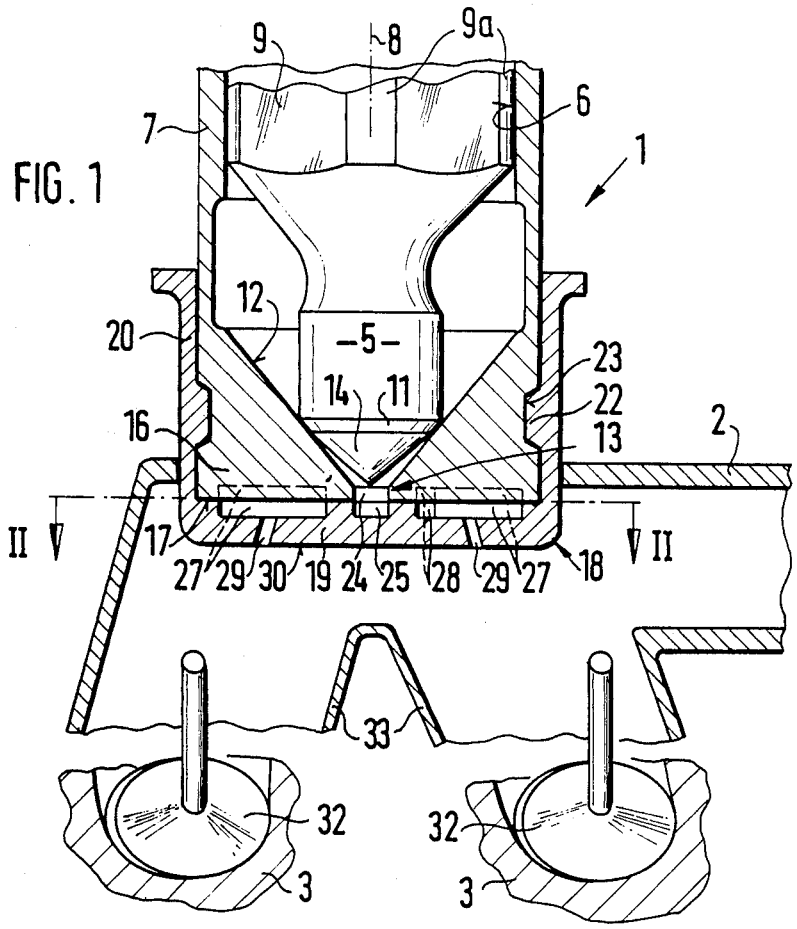
FIG. 1 is a fragmentary view of a fuel injection valve embodied in accordance with the invention.
Figure 2:
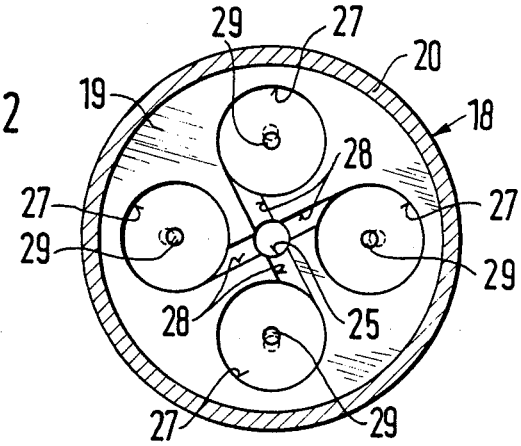
FIG. 2 is a section taken along the line II—II of FIG. 1.

The fuel injection valve 1 shown in FIGS. 1 and 2 serves preferably to supply fuel to the air intake tube of mixture-compressing internal combustion engines 3 with externally supplied ignition. If it is an electromagnetically actuatable valve, then the fuel injection valve 1 has an electrically triggerable magnetic circuit (not shown), by means of which a valve needle 5, connected to an armature of the magnetic circuit, is actuatable. The valve needle 5 slides in a guide bore 6 of a valve housing 7 in the axial direction. As a rule the valve housing 7 is assembled from a plurality of individual housing parts that are embodied symmetrically to a longitudinal axis 8 of the fuel injection valve and extend axially. The individual housing part of the valve housing 7 that is visible in the drawing is generally known as a nozzle body. For guiding the valve needle 5 inside the guide bore 6, spaced-apart guide surfaces 9*a* form fuel flow sections 9, for instance four in number, of the valve needle 5 are used; they may for example be embodied as square bars that permits an axial flow around them. For the sake of simplicity, only two guide sections 9 has been shown in the drawing. Downstream of the guide sections 9, a sealing seat 11 is formed on the valve needle 6; the seat 11 may be conical or spherical, for example, and when the fuel injection valve 1 is closed the seat 11 rests on a conical valve seat face 12, which is open toward the guide bore 6, in the so-called nozzle body of the valve housing 7. When the fuel injection valve is opened, the valve needle 5 and its sealing seat 11 rises from the valve seat face 12, and as a result, fuel can flow out of the guide bore 6, via the valve seat face 12, into an adjoining central blind bore opening 13 in the so-called nozzle body. The valve seat face 12 and the central opening 13 need not merge directly with one another; instead, further openings of conical or other contour may be located between the valve seat face and the central opening. The valve needle 5 may, as shown, have a conical needle tip 14 that terminates upstream of the central opening 13. However, the needle tip may also be provided with a pintle, which protrudes into the central opening 13 in a manner not shown.

The valve seat face 12 and the central opening 13 are provided on one housing end 16 of the fuel injection valve 1, which terminates at an end face 17. An attachment 18 is mounted on the end face 17; it may be embodied as a disk-like body, or as in the example shown may take the form of a cup-shaped cap with a bottom portion 19 resting on the end face 17 of the housing end 16. A tubular cylinder jacket 20 adjoining the bottom 19 extends in the axial direction and encompasses the housing end 16. An annular detent protrusion 22 snaps into a likewise annular detent groove 23, which is embodied with axial spacing relative to the end face 17 on the housing end 16, so that the bottom 19 rests directly on the end face 17. The cylinder jacket 20 of the attachment 18 should be embodied elastically, in such a way that it is possible to slip the attachment onto the housing end 16. The attachment 18 may also be made of plastic.

In the present exemplary embodiment, shown in FIG. 1, the central opening 13 is embodied by a first central opening portion 24 in the housing end 16 and a second central blind bore opening portion 25 in the bottom 19 of the attachment 18. The two portions 24, 25 of the central opening are flush with one another. At least two swirl chambers 27 of circular cross section are embodied in the bottom 19 of the attachment 18, preferably symmetrically with the longitudinal axis 8, and are open toward the end face 17 of the housing end 16 and are radially spaced apart from the second central opening portion 25. In FIG. 2, four swirl chambers 27 are shown, which depending on the particular construction of the associated engine are at equal or unequal distances from one another. One tangential conduit 28 leads from the second central opening portion 25 to each swirl chamber 27, discharging into the associated swirl chamber 27 at a tangent, preferably such that identical swirl directions are produced in the individual swirl chambers. The tangential conduits 28 are also embodied in the bottom 19. One metering opening 29 begins at the center of each swirl chamber 27, penetrating the bottom 19 of the attachment 18 and serving to perform fuel metering. The wall of the bottom 19 between each swirl chamber and the end face 30 of the bottom may be embodied as very thin, so that metering openings with a ratio of its length to its diameter of 1:2 can be manufactured. The metering openings 29 advantageously extend at an incline to the longitudinal axis 8 of the fuel injection valve. The inclinations of the metering openings 29 may be selected such that at least two of the fuel streams emerging from the metering openings are aimed at one inlet valve 32 of the engine 3, without touching each other or passing through one another; alternatively, in a different embodiment, the inclinations of the metering openings 29 may be selected such that at least two of the metering openings 29 produce fuel streams that are aimed in the direction of different individual intake tubes 33 and hence in the direction of different inlet valves 32, so that the inlet valves 32 of two different cylinders of the engine can be supplied directly with fuel using a single fuel injection valve 1.

The swirl chambers 27 and tangential conduits 28 need not necessarily be embodied in the bottom 19 of the attachment 18. The swirl chambers 27 and the tangential conduits 28 may instead be embodied as open toward the end face 17 in the housing end 16, as suggested by dashed lines in FIG. 1. Then the tangential conduits 28 begin at the first central opening portion 24, and only the metering openings 29 are embodied in the bottom 19 of the attachment 18.

It is true for both embodiments that the rotating fuel in each swirl chamber 27 virtually forms a potential vortex, with a central vortex core above each metering opening 29. This imposes a tangential component on the fuel emerging from each metering opening 29 at the bottom face 30, which in turn leads to a uniform distribution of fuel in each cone-shaped fuel stream. The cone angle of each fuel stream can be predetermined by varying the geometry of the tangential conduit 28 and swirl chamber 27. At high fuel speed, because the tangential conduit cross sections are small and the diameter of the swirl chamber is large, a large tangential speed component is produced at the circumference of the eddy core, so that the cone angle of the fuel stream is correspondingly large. With large cross sections of the tangential conduit and a small diameters of the swirl chambers, small cone angles of the fuel streams are produced.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A fuel injection valve for internal combustion engines having a valve housing embodied symmetrically to a longitudinal axis, a valve seat face formed on said housing, a valve closing element that cooperates with said valve seat face disposed in said valve housing, a central opening (13, 24, 25) downstream of the valve seat face (12), at least two tangential conduits (28) extending radially outward from said central opening, each of said tangential conduits discharging tangentially into a separate swirl chamber (27) within said fuel injection valve, each of said separate swirl chambers including a central metering opening (29) in a bottom surface thereof which directs fuel to the outside (30) of said fuel injection valve.

2. A fuel injection valve as defined by claim 1, in which each of said metering openings (29) extend in an inclined manner relative to the longitudinal axis (8) of the valve housing (7).

3. A fuel injection valve as defined by claim 1, in which each of said tangential conduits (28) discharge into the swirl chambers (27) such that identical fuel swirl directions are produced in the swirl chambers (27).

4. A fuel injection valve as defined by claim 1, in which each of said metering openings (29) are embodied on an end cap (18) disposed on the valve housing (7).

5. A fuel injection valve as defined by claim 4, in which each of said tangential conduits (28) and the swirl chambers (27) are embodied in said end cap (18).

6. A fuel injection valve as defined by claim 5, in which each of said tangential conduits (28) discharge into the swirl chambers (27) such that identical swirl directions are produced in the swirl chambers (27).

7. A fuel injection valve as defined by claim 1, which includes four swirl chambers and four tangential conduits with a metering opening in each of said swirl chambers.

8. A fuel injection valve as defined by claim 7, in which said metering openings are directed such that fuel can be injected through at least two of the metering openings (29) in the direction of different inlet valves (32) of the engine (3).

9. A fuel injection valve as defined by claim 1, in which each of said metering openings (29) are embodied in a bottom portion of an end cap (18) having an end face, embodied as thin, so that said metering openings (29) have a ratio of their length to their diameter of 1:2.

10. A fuel injection valve as defined by claim 7, in which said metering opening of each of said four swirl chambers have centers which are on a circle centered on said fuel injection valve.

11. A fuel injection valve as defined by claim 10, in which said metering openings of two radially opposite swirl chambers of said four swirl chambers have radii different from the radius of said circle.

12. A fuel injection valve as defined in claim 10, in which a spacing of said swirl chambers are equidistant from each other circumferentially.

13. A fuel injection valve as defined in claim 10, in which a spacing between said metering bores on said circle are not equal.

14. A fuel injection valve as defined in claim 13, which a circumferential spacing between two of said metering bores on said circle are equal to two other metering bores.

* * * * *